US009033651B2

(12) United States Patent
Czechowski et al.

(10) Patent No.: US 9,033,651 B2
(45) Date of Patent: May 19, 2015

(54) FLOW DISTRIBUTED BUFFERED/EDUCTED GAS SEAL

(75) Inventors: Edward S. Czechowski, Orchard Park, NY (US); Michael A. Nuchereno, Amherst, NY (US); Paul A. Leising, Tonawanda, NY (US); Nathan P. Vetter, Depew, NY (US)

(73) Assignee: Ingersoll-Rand Company, Davidson, NC (US)

( * ) Notice: Subject to any disclaimer, the term of this patent is extended or adjusted under 35 U.S.C. 154(b) by 642 days.

(21) Appl. No.: 13/262,627

(22) PCT Filed: Apr. 22, 2010

(86) PCT No.: PCT/US2010/032125

§ 371 (c)(1),
(2), (4) Date: Sep. 30, 2011

(87) PCT Pub. No.: WO2010/129189

PCT Pub. Date: Nov. 11, 2010

(65) Prior Publication Data

US 2012/0038112 A1 Feb. 16, 2012

Related U.S. Application Data

(60) Provisional application No. 61/175,375, filed on May 4, 2009.

(51) Int. Cl.
*F04D 29/10* (2006.01)

(52) U.S. Cl.
CPC ..... *F04D 29/104* (2013.01)

(58) Field of Classification Search
CPC ..... F04D 29/104
USPC ..... 415/110, 111, 112, 168.1, 168.2, 170.1, 415/174.3
See application file for complete search history.

(56) References Cited

U.S. PATENT DOCUMENTS 2,448,717 A * 9/1948 Jeffcock ..... 417/89
4,725,196 A * 2/1988 Kaneki et al. ..... 415/98

(Continued)

FOREIGN PATENT DOCUMENTS

DE 197 35 932 C1 11/1999
EP 1 369 594 A2 12/2003

(Continued)

OTHER PUBLICATIONS

Tchigique, B., "Garnitures Gaz Philosophie D'Instrumentation", Petrole et Techniques, Association Francaise Des Techniciens Du Petrole., Paris, FR, No. 370, Feb. 1, 1992, pp. 42-47, XP000263671; ISSN: 0152-5425, figures 10-13.

(Continued)

*Primary Examiner* — Nathaniel Wiehe
*Assistant Examiner* — Brian O Peters
(74) *Attorney, Agent, or Firm* — Krieg Devault LLP

(57) ABSTRACT

A system, in certain embodiments, includes a seal assembly having a seal body. The seal body includes an inlet buffer port and an outlet eduction port. The inlet buffer port is configured to receive a compressed buffer gas, such as shop air, which is injected into the inlet buffer port. The compressed buffer gas blocks the flow of a compressed process gas, such as land fill gas, by opposing the flow of the compressed process gas through the seal assembly. Both the compressed buffer gas and the compressed process gas may be expelled through the outlet eduction port.

27 Claims, 8 Drawing Sheets

(56) References Cited

U.S. PATENT DOCUMENTS

| | | | | |
|---|---|---|---|---|
| 6,227,034 | B1 * | 5/2001 | Trochesset | 73/23.42 |
| 6,582,185 | B2 * | 6/2003 | Lippert et al. | 415/58.4 |
| 6,802,689 | B2 * | 10/2004 | Nogiwa | 415/26 |
| 2002/0197154 | A1 | 12/2002 | Nogiwa | |
| 2004/0112593 | A1 * | 6/2004 | McGregor et al. | 166/242.1 |
| 2011/0076136 | A1 * | 3/2011 | Small et al. | 415/124.2 |

FOREIGN PATENT DOCUMENTS

| | | | |
|---|---|---|---|
| FR | 1 497 199 | A | 10/1967 |
| GB | 1 142 167 | A | 2/1969 |

OTHER PUBLICATIONS

Cameron, "Plant Air Centrifugal Compressors, Turbo-Air series featuring oil-free air," Cameron International, Printed in USA, Apr. 2009.

Cameron, "Process Gas Centrifugal Compressors, MSG series featuring oil-free process gas," Cameron International, Printed in USA, Sep. 2009.

Cameron, "Engineered Air, Industrial & Process Gas Centrifugal Compressors," Cameron International Corporation, Compression Systems Division, Jan. 2007.

Kabir, Omar M. et al., "Fuel Gas Boosters: Centrifugal Compressors as a Viable Method for Fuel Gas Boosting," Proceedings of IJPGC '02, 2002 International Joint Power Generation Conference, Phoenix, AZ, USA, Jun. 24-26, 2002.

Cooper Compression, "The MSG Compression Line," Cooper Cameron Corporation, Cooper Compression Division, Mar. 2005.

Cameron, "MSG Process Gas Compressors," Cameron International Corporation, Compression Systems Division.

Cooper Compression, "Turbo-Air 9000," Cooper Compression, Jul. 2005.

* cited by examiner

FLOW DISTRIBUTED BUFFERED/EDUCTED GAS SEAL

CROSS REFERENCE TO RELATED APPLICATION

This application claims priority to and benefit of PCT Patent Application No. PCT/US2010/032125, entitled "Flow Distributed Buffered/Educted Gas Seal," filed Apr. 22, 2010, which is herein incorporated by reference in its entirety, and which claims priority to and benefit of U.S. Provisional Patent Application No. 61/175,375, entitled "Flow Distributed Buffered/Educted Gas Seal," filed on May 4, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Gas compressors are used in a wide variety of industries including aerospace, automotive, oil and gas, power generation, food and beverage, pharmaceuticals, water treatment, and the like. The compressed gas may include air, nitrogen, oxygen, natural gas, or any other type of gas. Gas compressor systems generally include devices that increase the pressure of a gas by decreasing (e.g., compressing) its volume. Certain types of gas compressors employ one or more mechanisms that employ a rotational torque to compress an incoming gas. For instance, in a centrifugal gas compressor system, a gas is drawn into a housing through an inlet, the gas is compressed by a rotating impeller, and the gas is expelled from the housing. Often, the impeller or other rotating mechanism is driven by a rotating drive shaft that extends into the housing. In such a system, one or more seals are typically disposed around the drive shaft to minimize the amount of compressed gas that leaks around the drive shaft. However, certain gases (e.g., land fill gas) are extremely corrosive and harmful to typical seals used in centrifugal gas compressor systems. As such, centrifugal compressors tend to be used less frequently in certain applications (e.g., land fill gas applications).

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
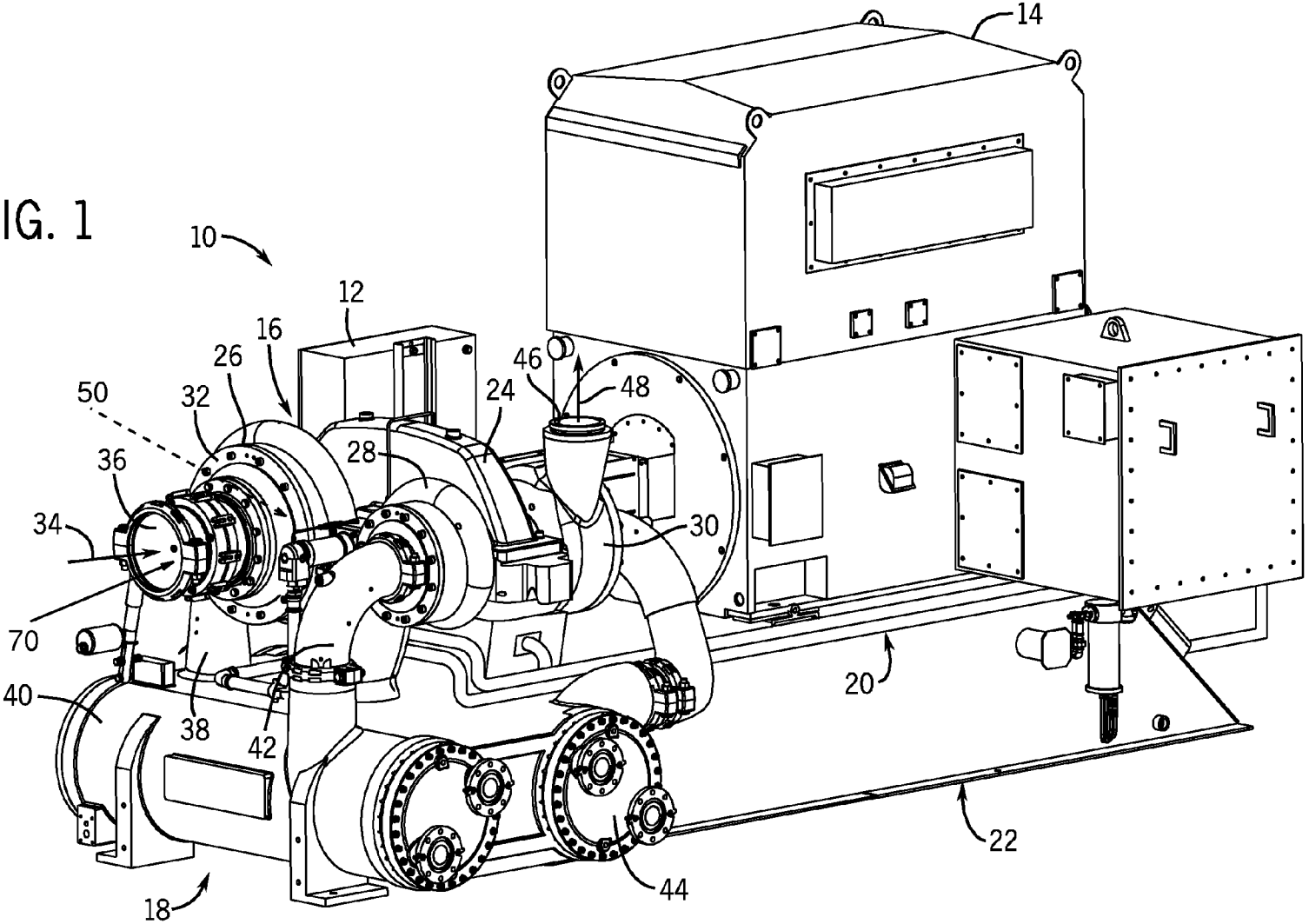
FIG. 1 is a perspective view of an exemplary embodiment of a compressor system employing a buffered/educted gas seal.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, in certain gas compressor systems, a gas is drawn into a housing through an inlet, the gas is compressed by a rotating impeller, and the gas is expelled from the housing. The impeller or other rotating mechanism is driven by a rotating drive shaft that extends into the housing. In such a system, one or more seals are disposed around the drive shaft to reduce the amount of compressed gas that leaks around the drive shaft. The gas compressor system may employ a wet seal and/or a dry-face seal for this purpose. Wet seals may be simple, but allow more gas to pass than a dry-face seal employed in the same environment. Dry-face seals may be complex in design and employ an equally complex control system. However, even a dry-face seal is susceptible to gas leaks and creates an additional cost relating to installation, operation, and maintenance of the seal.

Unfortunately, compressed gas, sometimes referred to as "process gas," that leaks past the seal and into the housing is generally undesirable for several reasons. For instance, process gas leaking past the seal may not be recovered, resulting in a net decrease in the gas product output from the compressor. In other words, process gas that leaks by the seal may be unrecoverable or cost a great deal to recover. In addition, the process gas may contain corrosive elements (e.g., carbonic acid, sulfuric acid, carbon dioxide, and so forth) which may adversely affect the functioning of lubrication oil in the gearing of the gas compressor system, among other things. Further, process gas that leaks past the seal may produce other safety concerns that lead to additional procedures and devices in the compression process. For example, the gas compressor system may employ additional seals and/or control systems to capture the process gas, scrub (e.g., clean) the gas, flash (burn off) the process gas, or the like. This can also add to the cost of installing, operating, and maintaining the gas compressor system.

Certain embodiments described herein include a system and method that addresses one or more of the above-mentioned inadequacies of a conventional gas compressor system. In certain embodiments described herein, a gas compressor system includes a buffered/educted gas seal. The buffered/educted gas seal may address the above-mentioned inadequacies by injecting a buffer gas into a body of the buffered/educted gas seal through an inlet buffer port. The buffer gas may oppose the flow of the process gas along an axis of a drive shaft of the gas compressor system, thereby blocking leakage of the process gas into a gearbox of the gas compressor system. In particular, the buffer gas may be injected into the body of the buffered/educted gas seal at a higher pressure than the compressed process gas. Since the pressure of the buffer gas is greater than the pressure of the process gas, the buffer gas opposes further leakage of the process gas along the axis of the drive shaft. Both the buffer gas and the process gas may be collected and expelled from the body of the buffered/educted gas seal through an outlet eduction port.

FIG. 1 is a perspective view of an exemplary embodiment of a compressor system 10 employing a seal assembly 50 (e.g., a buffered/educted gas seal). The compressor system 10 is generally configured to compress gas in various applications. For example, the compressor system 10 may be employed in applications relating to the automotive industries, electronics industries, aerospace industries, oil and gas industries, power generation industries, petrochemical industries, and the like. In addition, the compressor system 10 may be employed to compress land fill gas, which may contain certain corrosive elements. For example, the land fill gas may contain carbonic acid, sulfuric acid, carbon dioxide, and so forth.

In general, the compressor system 10 includes one or more of a reciprocating, rotary, axial, and/or a centrifugal gas compressor that is configured to increase the pressure of (e.g., compress) incoming gas. In the illustrated embodiment, the compressor system 10 includes a centrifugal compressor. More specifically, the depicted embodiment includes a Turbo-Air 9000 manufactured by Cameron of Houston, Tex. In some embodiments, the compressor system 10 includes a power rating of approximately 150 to approximately 3,000 horsepower (hp), discharge pressures of approximately 80 to 150 pounds per square inch (psig) and an output capacity of approximately 600 to 15,000 cubic feet per minute (cfm). Although the illustrated embodiment includes only one of many compressor arrangements that can employ a buffered/educted gas seal 50, other embodiments of the compressor system 10 may include various compressor arrangements and operational parameters. For example, the compressor system 10 may include a different type of compressor, a lower horsepower rating suitable for applications having a lower output capacity and/or lower pressure differentials, a higher horsepower rating suitable for applications having a higher output capacity and/or higher pressure differentials, and so forth.

In the illustrated embodiment, the compressor system 10 includes a control panel 12, a drive unit 14, a compressor unit 16, an intercooler 18, a lubrication system 20, and a common base 22. The common base 22 generally provides for simplified assembly and installation of the compressor system 10. For example, the control panel 12, the drive unit 14, the compressor unit 16, intercooler 18, and the lubrication system 20 are coupled to the common base 22. This enables installation and assembly of the compressor system 10 as modular components that are pre-assembled and/or assembled on site.

The control panel 12 includes various devices and controls configured to monitor and regulate operation of the compressor system 10. For example, in one embodiment, the control panel 12 includes a switch to control system power, and/or numerous devices (e.g., liquid crystal displays and/or light emitting diodes) indicative of operating parameters of the compressor system 10. In other embodiments, the control panel 12 includes advanced functionality, such as a programmable logic controller (PLC) or the like.

The drive unit 14 generally includes a device configured to provide motive power to the compressor system 10. The drive unit 14 is employed to provide energy, typically in the form of a rotating drive unit shaft, which is used to compress the incoming gas. Generally, the rotating drive unit shaft is coupled to the inner workings of the compressor unit 16, and rotation of the drive unit shaft is translated into rotation of an impeller that compresses the incoming gas. In the illustrated embodiment, the drive unit 14 includes an electric motor that is configured to provide rotational torque to the drive unit shaft. In other embodiments, the drive unit 14 may include other motive devices, such as a compression ignition (e.g., diesel) engine, a spark ignition (e.g., internal gas combustion) engine, a gas turbine engine, or the like.

The compressor unit 16 typically includes a gearbox 24 that is coupled to the drive unit shaft. The gearbox 24 generally includes various mechanisms that are employed to distribute the motive power from the drive unit 14 (e.g., rotation of the drive unit shaft) to impellers of the compressor stages. For instance, in operation of the system 10, rotation of the drive unit shaft is delivered via internal gearing to the various impellers of a first compressor stage 26, a second compressor stage 28, and a third compressor stage 30. In the illustrated embodiment, the internal gearing of the gearbox 24 typically includes a bull gear coupled to a drive shaft that delivers rotational torque to the impeller.

It will be appreciated that such a system (e.g., where a drive unit 14 that is indirectly coupled to the drive shaft that delivers rotational torque to the impeller) is generally referred to as an indirect drive system. In certain embodiments, the indirect drive system may include one or more gears (e.g., gearbox 24), a clutch, a transmission, a belt drive (e.g., belt and pulleys), or any other indirect coupling technique. However, another embodiment of the compressor system 10 may include a direct drive system. In an embodiment employing the direct drive system, the gearbox 24 and the drive unit 14 may be essentially integrated into the compressor unit 16 to provide torque directly to the drive shaft. For example, in a direct drive system, a motive device (e.g., an electric motor) surrounds the drive shaft, thereby directly (e.g., without intermediate gearing) imparting a torque on the drive shaft. Accordingly, in an embodiment employing the direct drive system, multiple electric motors can be employed to drive one or more drive shafts and impellers in each stage of the compressor unit 16. However, any type of indirect drive or direct drive system may be used with the buffered/educted gas seal 50 in certain embodiments.

The gearbox 24 includes features that provide for increased reliability and simplified maintenance of the system 10. For example, the gearbox 24 may include an integrally cast multistage design for enhanced performance. In other words, the gearbox 24 may include a singe casting including all three scrolls helping to reduce the assembly and maintenance concerns typically associated with systems 10. Further, the gearbox 24 may include a horizontally split cover for easy removal and inspection of components disposed internal to the gearbox 24.

As discussed briefly above, the compressor unit 16 generally includes one or more stages that compress the incoming gas in series. For example, in the illustrated embodiment, the compressor unit 16 includes three compression stages (e.g., a three stage compressor), including the first stage compressor 26, the second stage compressor 28, and the third stage compressor 30. Each of the compressor stages 26, 28, and 30 includes a centrifugal scroll that includes a housing encompassing one or more gas impellers. In operation, incoming gas is sequentially passed into each of the compressor stages 26, 28, and 30 before being discharged at an elevated pressure.

Operation of the system 10 includes drawing a gas into the first stage compressor 26 via a compressor inlet 32 and in the direction of arrow 34. As illustrated, the compressor unit 16 also includes a guide vane 36. The guide vane 36 includes vanes and other mechanisms to direct the flow of the gas as it enters the first compressor stage 26. For example, the guide vane 36 may impart a swirling motion to the inlet air flow in the same direction as the impeller of the first compressor stage 26, thereby helping to reduce the work input at the impeller to compress the incoming gas.

After the gas is drawn into the system 10 via the compressor inlet 32, the first stage compressor 26 compresses and discharges the compressed gas via a first duct 38. The first duct 38 routes the compressed gas into a first stage 40 of the intercooler 18. The compressed gas expelled from the first compressor stage 26 is directed through the first stage intercooler 40 and is discharged from the intercooler 18 via a second duct 42.

Generally, each stage of the intercooler 18 includes a heat exchange system to cool the compressed gas. In one embodiment, the intercooler 18 includes a water-in-tube design that effectively removes heat from the compressed gas as it passes over heat exchanging elements internal to the intercooler 18. An intercooler stage is provided after each compressor stage to reduce the gas temperature and to improve the efficiency of each subsequent compression stage. For example, in the illustrated embodiment, the second duct 42 routes the compressed gas into the second compressor stage 28 and a second stage 44 of the intercooler 18 before routing the gas to the third compressor stage 30.

After the third stage 30 compresses the gas, the compressed gas is discharged via a compressor discharge 46 in the direction of arrow 48. In the illustrated embodiment, the compressed gas is routed from the third stage compressor 30 to the discharge 46 without an intermediate cooling step (e.g., passing through a third intercooler stage). However, other embodiments of the compressor system 10 may include a third intercooler stage or similar device configured to cool the compressed gas as it exits the third compressor stage 30. Further, additional ducts may be coupled to the discharge 46 to effectively route the compressed gas for use in a desired application (e.g., drying applications).

Each of the compressor stages 26, 28, and 30 includes one or more impellers that are located in a housing and are driven by rotation of a pinion. In certain applications, the pinion may extend though a pinion bore in the housing. Unfortunately, in a system that employs a pinion that extends through the housing, gas may leak from the impeller into the gearbox 24. This is generally attributed to seals that do not provide a complete seal between the pinion and the pinion bore. Gas that leaks past the seal and into the gearbox 24 is generally undesirable for several reasons. In particular, the gas may contain corrosive elements (e.g., carbonic acid, sulfuric acid, carbon dioxide, and so forth) which may adversely affect the functioning of lubrication oil in the gearing of the gearbox 24, among other things. Further, gas that leaks past the seal may produce other concerns that lead to additional procedures and devices in the compression process. Disclosed below are embodiments of the compressor system 10 that employ a buffered/educted gas seal 50, which may be used to minimize the amount of gas allowed to leak from the impeller into the gearbox 24.

Figure 2:
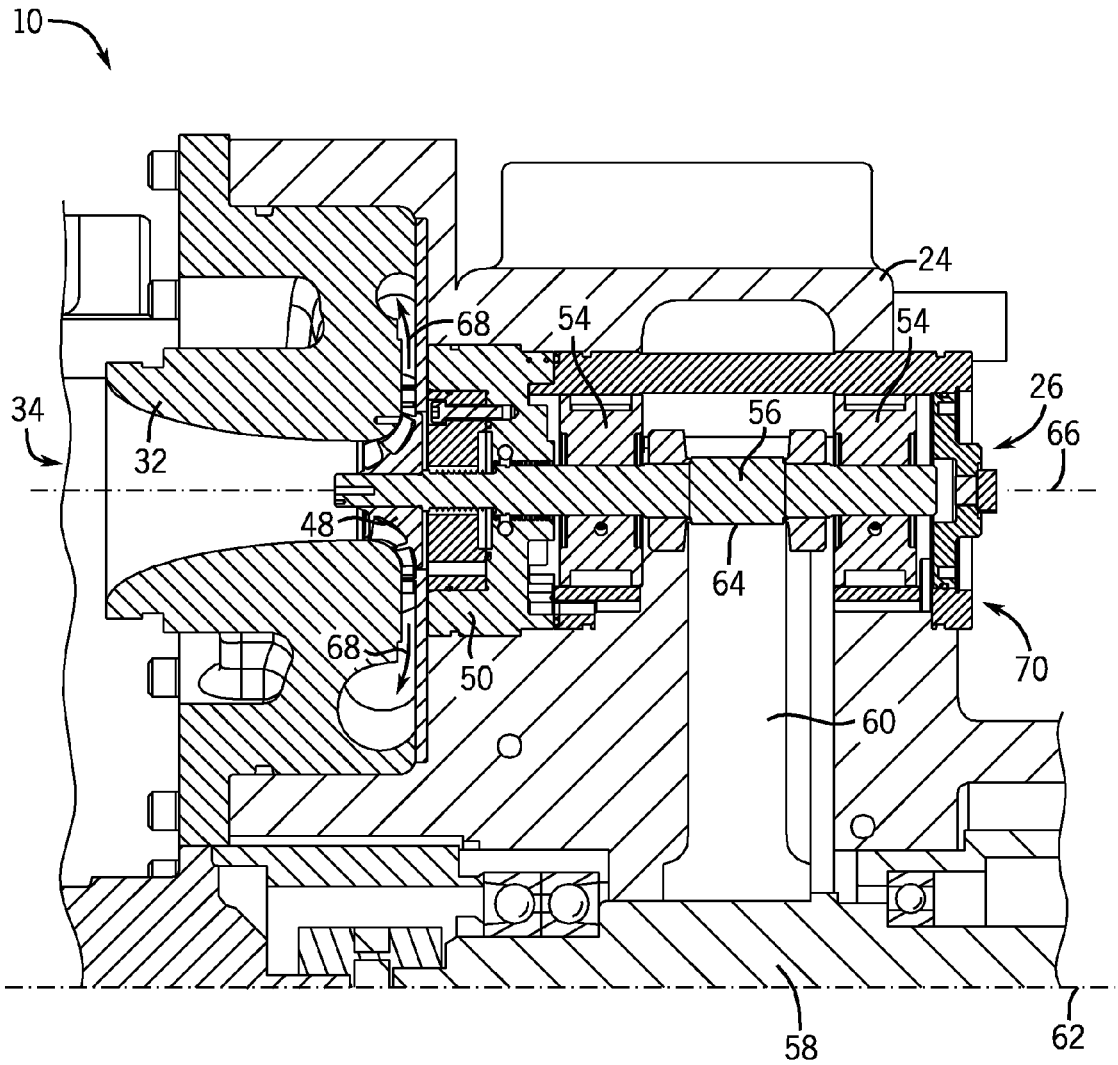
FIG. 2 is a cross-section view of an exemplary embodiment of a first compressor stage within the compressor system of FIG. 1.

FIG. 2 is a cross-section view of an exemplary embodiment of the first compressor stage 26 within the compressor system 10 of FIG. 1. However, the components of the first compressor stage 26 are merely illustrative of any of the compressor stages 26, 28, and 30 and may, in fact, be indicative of the components in a single stage compressor system 10. As illustrated in FIG. 1, the first compressor stage 26 may include an impeller 48, a seal assembly 50 (e.g., a buffered/educted gas seal), a bearing assembly 52, two bearings 54 within the bearing assembly 52, and a pinion shaft 56, among other things. In general, the seal assembly 50 and the bearing assembly 52 reside within the gearbox 24. The two bearings 54 provide support for the pinion shaft 56, which drives rotation of the impeller 48.

In certain embodiments, a drive shaft 58, which is driven by the drive unit 14 of FIG. 1, may be used to rotate a bull gear 60 about a central axis 62. The bull gear 60 may mesh with the pinion shaft 56 of the first compressor stage 26 via a pinion mesh 64. In fact, the bull gear 60 may also mesh with another pinion shaft associated with the second and third compressor stages 28, 30 via the pinion mesh 64. Rotation of the bull gear 60 about the central axis 62 may cause the pinion shaft 56 to rotate about a first stage axis 66, causing the impeller 48 to rotate about the first stage axis 66. As discussed above, gas may enter the compressor inlet 32, as illustrated by arrow 34. The rotation of the impeller 48 causes the gas to be compressed and directed radially, as illustrated by arrows 68. Unfortunately, as the gas is compressed, a certain amount of the compressed gas may leak behind the impeller 48. As discussed in greater detail below, the seal assembly 50 includes a gas seal portion and an oil seal portion, which collectively comprise a buffered/educted gas seal, which helps minimize the amount of gas allowed to leak into the gearbox 24. By minimizing the amount of gas into the gearbox 24, oil used to lubricate the bearings 54 may not be subjected to the corrosive effects of certain elements within the gas, such as carbonic acid, sulfuric acid, carbon dioxide, and so forth.

Figure 3A:
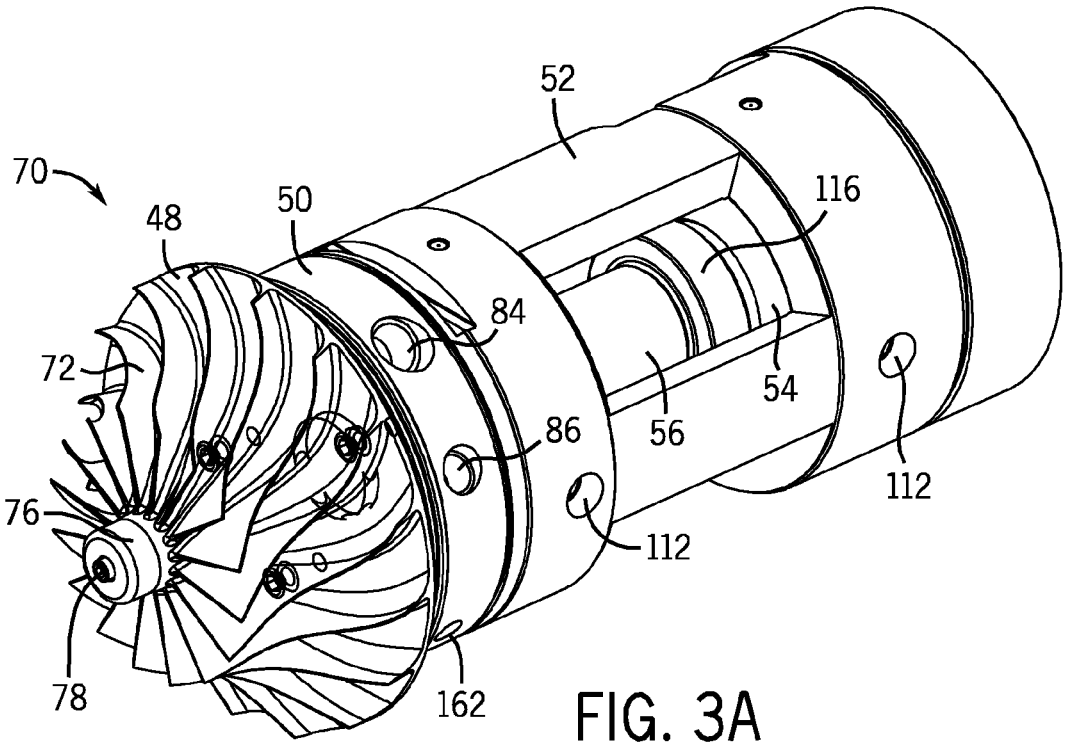
FIGS. 3A and 3B are perspective views of an exemplary embodiment of an impeller, a seal assembly, a bearing assembly, bearings, and a pinion shaft of the first compressor stage of FIG. 1, collectively referred to as a compression stage rotor assembly.
Figure 3B:
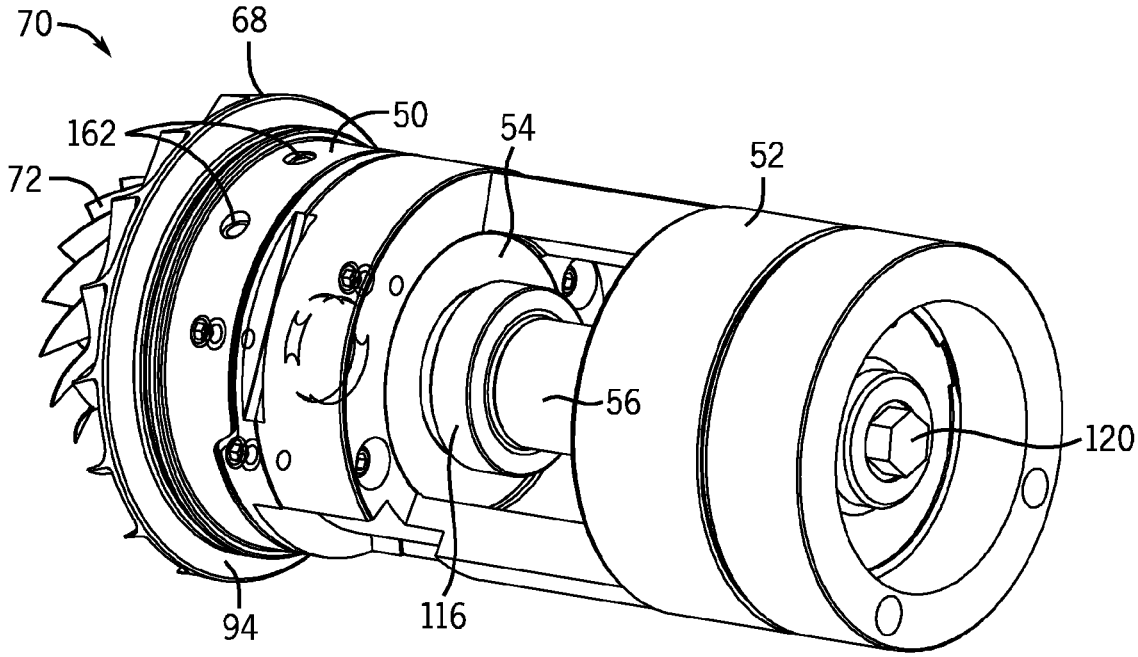
Figure 4A:
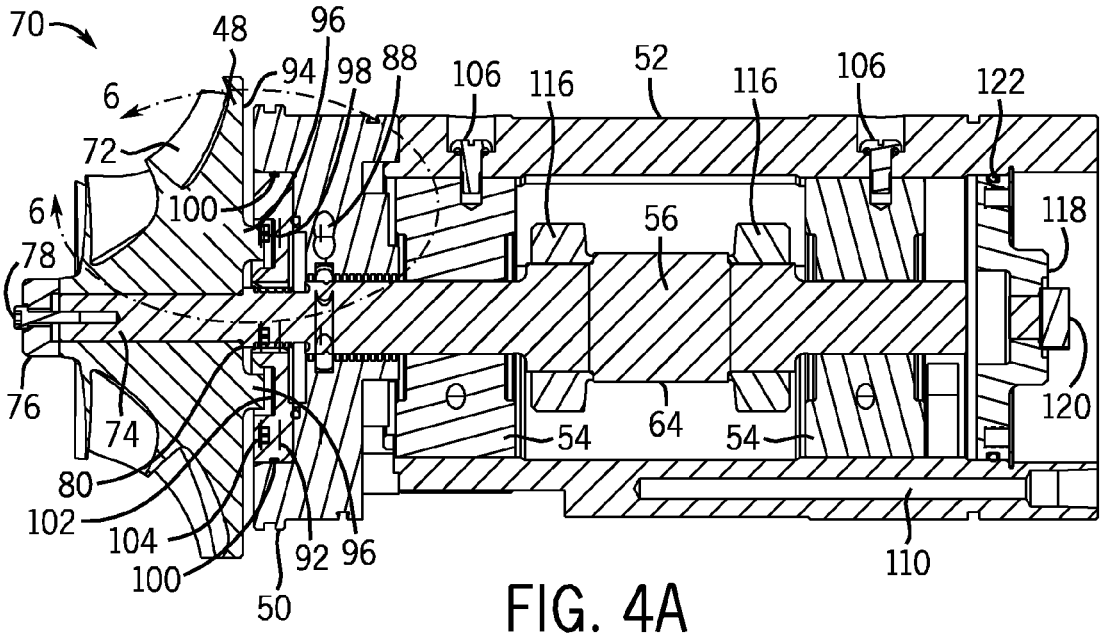
FIGS. 4A and 4B are cross-section top and side views, respectively, of an exemplary embodiment of the compression stage rotor assembly.
Figure 4B:
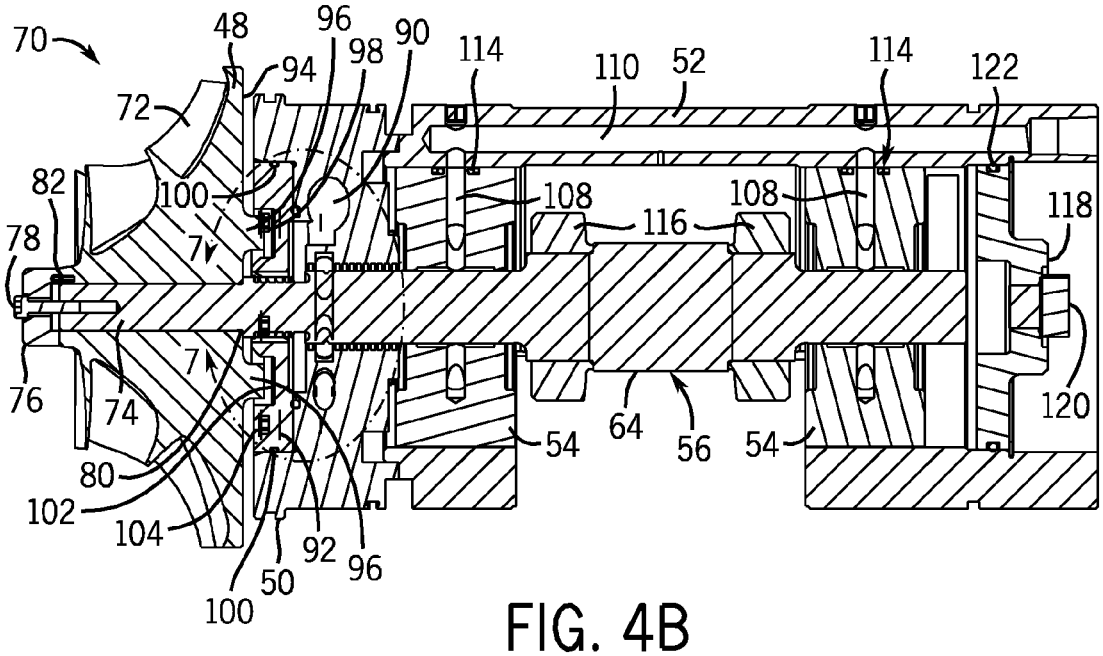
Figure 5:
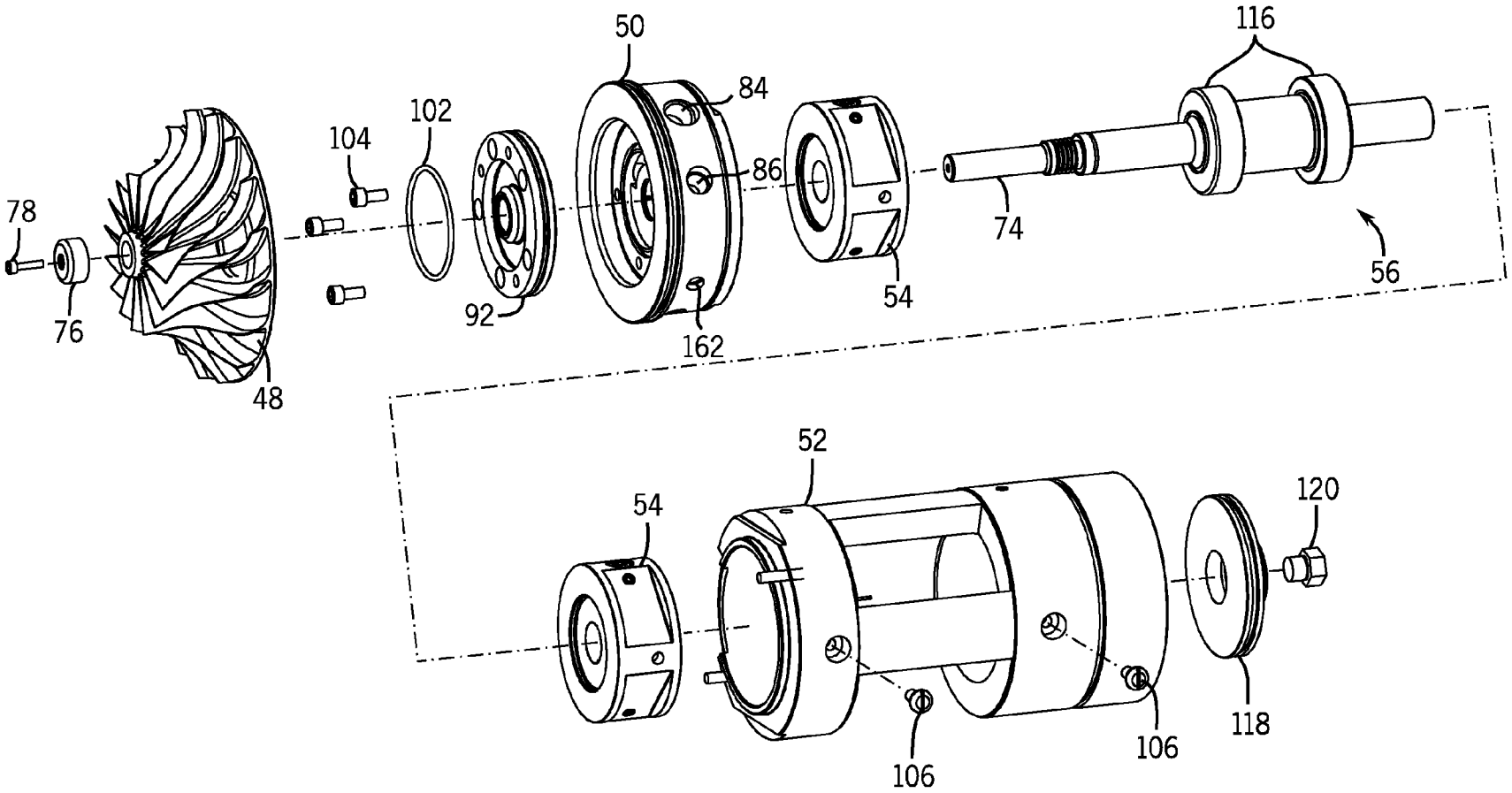
FIG. 5 is an exploded view of an exemplary embodiment of the compression stage rotor assembly.

For reference purposes, the impeller 48, seal assembly 50, bearing assembly 52, bearings 54, and pinion shaft 56 of the first compressor stage 26 may be referred to collectively as a compression stage rotor assembly 70. As discussed above, these components may be illustrative of components of any of the stages of the compressor system 10 of FIG. 1. FIGS. 3A and 3B are perspective views of an exemplary embodiment of the compression stage rotor assembly 70. In addition, FIGS. 4A and 4B are cross-section top and side views, respectively, of an exemplary embodiment of the compression stage rotor assembly 70. Furthermore, FIG. 5 is an exploded view of an exemplary embodiment of the compression stage rotor assembly 70.

As illustrated in FIGS. 3A and 3B, the impeller 48 includes a plurality of blades 72 extending radially from its center. In certain embodiments, as illustrated in FIGS. 4A and 4B, the impeller 48 may be attached to an axial impeller end 74 of the pinion shaft 56 by a rotor balance washer 76. In particular, in certain embodiments, a capscrew 78 may screw axially into the axial impeller end 74 of the pinion shaft 56, thereby holding the impeller 48 in place about the axial impeller end 74 of the pinion shaft 56. In particular, a notch 80 extending radially from the pinion shaft 56 may limit axial movement of the impeller 48 when the capscrew 78 is engaged, with the rotor balance washer 76 biased axially against the impeller 48. In certain embodiments, as illustrated in FIG. 4B, at least one alignment pin 82 may be used to ensure that the impeller 48 does not rotate about the axial impeller end 74 of the pinion shaft 56.

Returning to FIGS. 3A and 3B, the seal assembly 50 may include at least one eduction port outlet 84 and at least one buffer port inlet 86. The operation of the eduction port outlet(s) 84 and the buffer port inlet(s) 86 will be discussed in greater detail below with respect to FIGS. 6 through 8. In general, pressurized buffer gas, such as shop air, may be injected into the buffer port inlet(s) 86 to help prevent leakage of compressed process gas (e.g., land fill gas) around the impeller 48 into the gearing of the gearbox 24 of FIG. 2. In addition, in certain embodiments, the process gas which has leaked into the seal assembly 50 from the impeller 48 may be directed back to the compressor inlet 32 via the eductor port outlet(s) 84. In particular, as illustrated in FIGS. 4A and 4B, at least one buffer port 88 within the seal assembly 50 may be used to introduce the compressed buffer gas and at least one eduction port 90 may be used to collect and expel compressed process gas which has leaked into the seal assembly 50.

As illustrated in FIGS. 4A, 4B, 5A, and 5B, in certain embodiments, the seal assembly 50 may be associated with a seal insert 92. The seal insert 92 may fit within an inner annular region of the seal assembly 50. In general, the seal insert 92 may be configured to create a seal on a back face 94 of the impeller 48. In particular, as illustrated in FIGS. 4A and 4B, in certain embodiments, an annular lip 96 protruding axially from the back face 94 of the impeller 48 may be configured to mate with an annular groove 98 extending axially into a surface of the seal insert 92 such that a certain amount of process gas may be blocked from leaking further into the seal assembly 50. In certain embodiments, a first o-ring 100 may be used to create a seal between the seal assembly 50 and the seal insert 92. As illustrated in FIG. 5, a second o-ring 102 may be used to further the seal between the back face 94 of the impeller 48 and the seal insert 92. In addition, a plurality of bolts 104 may be used to attach the seal insert 92 within the seal assembly 50.

The two bearings 54 support the pinion shaft 56 within the bearing assembly 52. As illustrated in FIG. 4A, the bearings 54 may be coupled to the bearing assembly 52 using a plurality of screws 106. In addition, as illustrated in FIG. 4B, lubrication conduits 108 within the bearings 54 may be used to introduce lubrication oil into the bearings 54. More specifically, the lubrication conduits 108 may be supplied with lubrication oil from a lubrication manifold 110 which extends axially within a wall of the bearing assembly 52. The lubrication manifold 110 fluidically couples to the lubrication conduits 108 of the bearings 54 via the lubrication orifices 112 of the bearings 54, as illustrated in FIG. 3A. Leakage of the lubrication oil may be minimized by using a plurality of o-rings 114, as illustrated in FIG. 4B.

In certain embodiments, as illustrated in FIGS. 4A and 4B, the pinion shaft 56 may include thrust collars 116 on either side of the pinion mesh 64, axially between the bearings 54 and the pinion mesh 64. In general, the thrust collars 116 may cancel out a substantial amount of axial thrust loads, which may improve the efficiency of the compressor system 10 (e.g., by reducing power losses of the gearbox 24). In addition, the thrust collars 116 may transfer the remaining net thrust load to the bull gear 60 of FIG. 2, where it may be absorbed by a low-speed thrust bearing.

As illustrated in FIGS. 4A and 4B, in certain embodiments, the compression stage rotor assembly 70 may include a bearing retainer 118, which may be held in place by a plug 120. The bearing retainer 118 may help protect the components of the compression stage rotor assembly 70 from the environment (e.g., dust, dirt, and so forth). The bearing retainer 118 may also protect users from the rotating components of the compression stage rotor assembly 70 (e.g., protecting against users getting their fingers caught in the rotating components). In addition, the bearing retainer 118 may help the bearings 54 retain lubrication oil within the gearbox 24. In certain embodiments, the plug 120 may be threaded and configured to screw axially into the bearing retainer 118. The plug 120 may be used as an access point to the compression stage rotor assembly 70 for measurement purposes, among other things.

Figure 6:
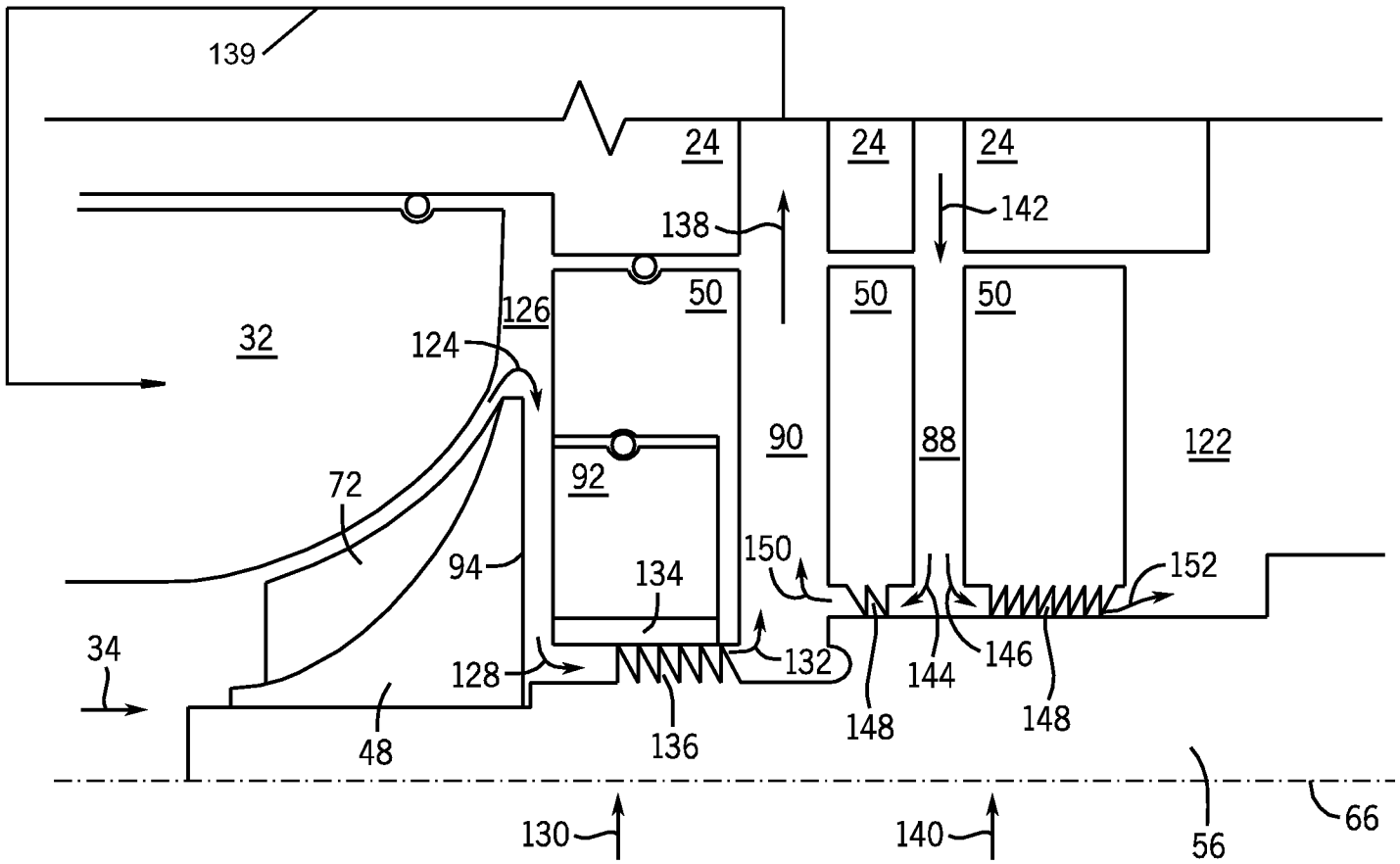
FIG. 6 is a cross-section view of an exemplary embodiment of the impeller, pinion, seal assembly and associated seal insert of the compression stage rotor assembly of FIGS. 3 through 5, as indicated by arcuate line 6-6 in FIG. 4A.

FIG. 6 is a cross-section view of an exemplary embodiment of the impeller 48, pinion shaft 56, seal assembly 50 and associated seal insert 92 of the compression stage rotor assembly 70 of FIGS. 3 through 5, as indicated by arcuate line 6-6 in FIG. 4A. In particular, the embodiment illustrated in FIG. 6 illustrates how the eduction port 90 and the buffer port 88 may be used to minimize leakage of the compressed process gas into a gearbox cavity 122, which includes the bearings 54, pinion mesh 64, and so forth. As discussed above, the compressed process gas may enter the compressor inlet 32, as illustrated by arrow 34. After being compressed, a certain amount of the compressed process gas may leak behind the back face 94 of the impeller 48, as illustrated by arrow 124. Since the process gas has been compressed, it may typically be at an elevated pressure when traversing along the back face 94 of the impeller 48. Conversely, the gearbox cavity 122 may typically be under vacuum. As such, the compressed process gas may generally tend to leak from a high-pressure region 126 near the impeller 48 to the low-pressure gearbox cavity 122. In particular, the compressed process gas may gradually leak from the back face 94 of the impeller 48 between the seal insert 92 and the pinion shaft 56, as illustrated by arrow 128.

A gas seal portion 130 of the seal assembly 50 and associated seal insert 92 may substantially reduce the amount of process gas allowed to leak into the eduction port 90, as illustrated by arrow 132. In certain embodiments, the gas seal portion 130 of the seal assembly 50 and associated seal insert 92 may include a babbitted surface 134 on a radially inner surface of the seal insert 92. As the name suggests, the babbitted surface 134 may be comprised of a soft metal composition. The babbitted surface 134 may interface with annular teeth 136 which extend radially outward from the pinion shaft 56. The pinion shaft 56 and, therefore, the annular teeth 136 may be comprised of a harder metal composition than that of the babbitted surface 134. Over time, the annular teeth 136 of the pinion shaft 56 may cut into the babbitted surface 134, creating a close fit between the two and allowing for decreased leakage of the compressed process gas into the eduction port 90, as illustrated by arrow 132. As discussed above, whatever process gas does leak into the eduction port 90 may be directed out of the eduction port 90, as illustrated by arrow 138. Furthermore, in certain embodiments, the process gas may be directed back to the compressor inlet 32 as indicated by arrow 139 (e.g., connection line), where it may be compressed again, thereby reducing the total amount of leakage from the compressor system 10. In addition, by directing this process gas back to the compressor inlet 32, the overall efficiency of the of the compressor system 10 may be increased since the process gas, which might otherwise be lost, is compressed for further use.

An oil seal portion 140 of the seal assembly 50 may further reduce the amount of process gas which is allowed to leak along the pinion shaft 56 into the gearbox cavity 122. In particular, in certain embodiments, the buffer port 88 may be used to inject buffer gas (e.g., shop air or other relatively non-corrosive gases) into the oil seal portion 140, as illustrated by arrow 142. Upon reaching the pinion shaft 56, the buffer gas may be split between an axial upstream flow path 144 and an axial downstream flow path 146 adjacent the pinion shaft 56. In certain embodiments, the oil seal portion 140 may include aluminum labyrinth teeth 148 which extend from a radially inner surface of the seal assembly 50. These teeth 148 may, to a certain degree, minimize the amount of buffer gas allowed to flow from the buffer port 88 to both the eduction port 90 and the gearbox cavity 122, as illustrated by arrows 150 and 152, respectively.

In general, the buffer gas may be sufficiently pressurized to counteract the pressure of the process gas leaking into the eduction port 90. More specifically, the pressure of the process gas may be adjusted by an operator or a system controller such that the pressure of the process gas is greater than the pressure of the process gas. As such, the pressure of the buffer gas flowing from the buffer port 88 to the eduction port 90, as illustrated by arrow 150, may overcome the pressure of the process gas leaking into the eduction port 90, as illustrated by arrow 132. In particular, the flow of buffer gas may oppose and even block the flow of the process gas. Accordingly, the remaining process gas leaking from the impeller 48 through the gas seal portion 130 of the seal assembly 50 may be directed out through the eduction port 90 instead of being allowed to further leak through the oil seal portion 140 of the seal assembly 50. As such, only buffer gas will be allowed to flow into the gearbox cavity 122, as illustrated by arrow 152. As opposed to the process gas, the buffer gas used will generally not be corrosive to the bearings 54, lubrication oil, and other gearbox 24 components. For instance, in certain embodiments, the buffer gas used may simply be compressed air. Therefore, using the buffer port 88 to inject buffer gas into the seal assembly 50 may help prevent leakage of the compressed process gas past the seal assembly 50 into the gearbox cavity 122, which includes the bearings 54, pinion mesh 64, and so forth.

Figure 7:
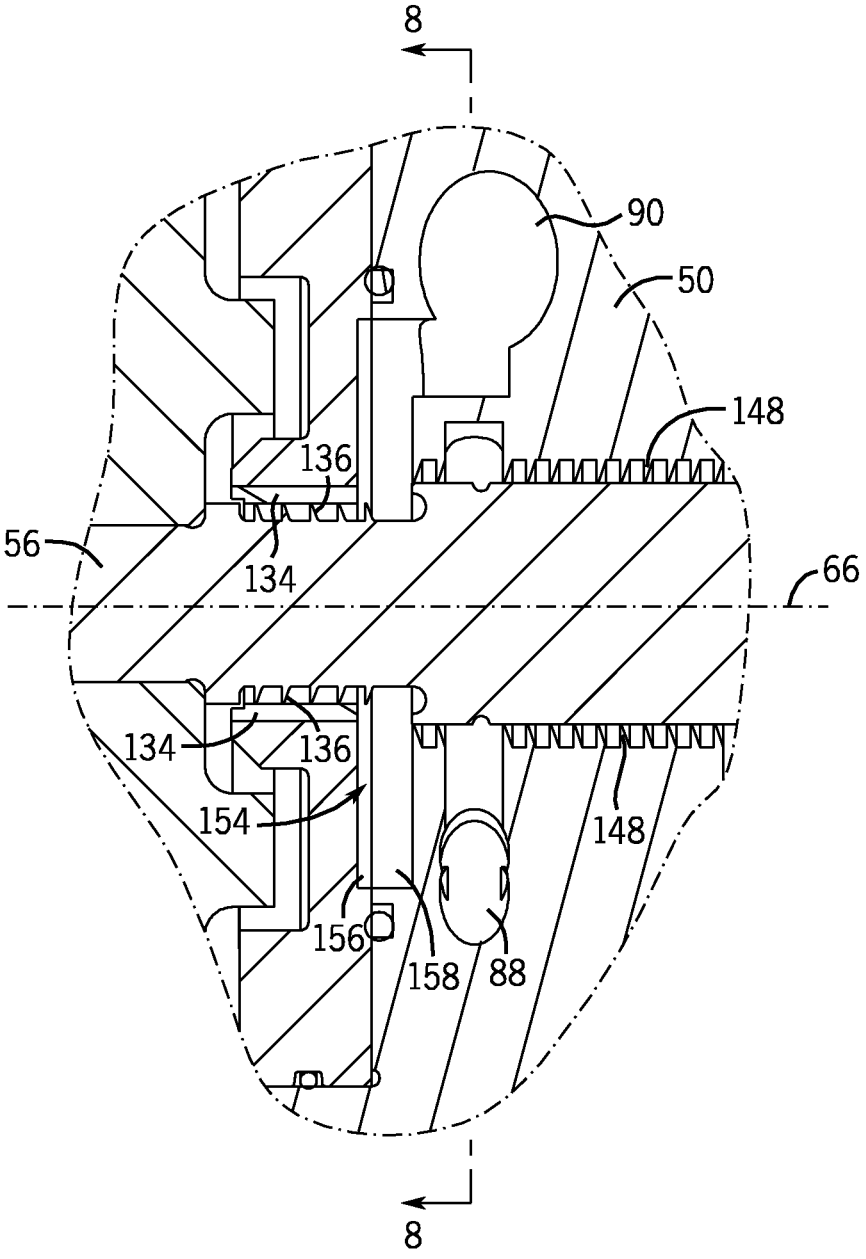
FIG. 7 is a cross-section view of an exemplary embodiment of the pinion, seal assembly, and associated insert of FIG. 6, as indicated by arcuate line 7-7 in FIG. 4B.

FIG. 7 is a cross-section view of an exemplary embodiment of the pinion shaft 56, seal assembly 50, and associated seal insert 92 of FIG. 6, as indicated by arcuate line 7-7 in FIG. 4B. In the illustrated embodiment, an eduction collection region 154 may separate the seal insert 92 and the seal assembly 50. The eduction collection region 154 may act as a collection region into which process gas, which has leaked past the babbitted surface 134 and the annular teeth 136 of the pinion shaft 56, may be collected before being directed into the eduction port 90. For example, the eduction collection region 154 may, in certain embodiments, include a first annular space 156 cut out of the seal insert 92 which is configured to mate with a second annular space 158 cut out of the seal assembly 50.

Figure 8:
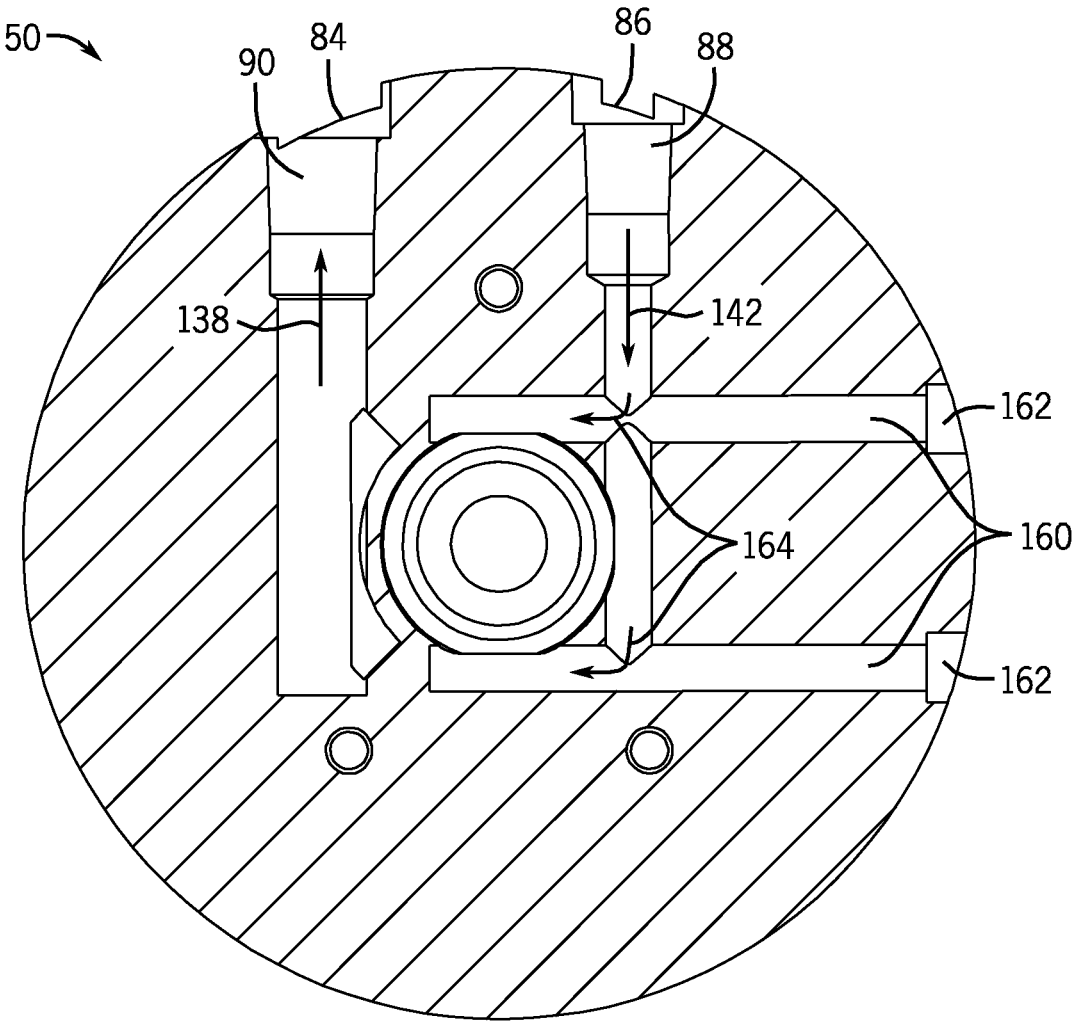
FIG. 8 is a cross-section view of an exemplary embodiment of the seal assembly, as indicated by arcuate line 8-8 in FIG. 7.

In the illustrated embodiment, the eduction port 90 may be located within the seal assembly 50 at generally the same axial location along the axis 66 as the buffer port 88. Such alignment may facilitate the internal machining of the seal assembly 50. For instance, FIG. 8 is a cross-section view of an exemplary embodiment of the seal assembly 50, as indicated by arcuate line 8-8 in FIG. 7. As illustrated in FIG. 8, the buffer port 88 and the eduction port 90 may be generally located along a common axial plane of the seal assembly 50. As discussed above, the buffer gas may be injected through the buffer port inlet 86 into the buffer port 88, as illustrated by arrow 142, and the buffer gas and process gas may be expelled out of the eduction port 90 through the eduction port outlet 84, as illustrated by arrow 138. However, as illustrated in FIG. 7, the buffer port 88 and the eduction port 90 are not in direct fluidic communication with each other. Rather, the eduction collection region 154 may collect and direct the process gas and buffer gas into the eduction port 90. Returning to FIG. 8, the buffer port 88 may, in certain embodiments, be in direct fluidic communication with buffer cross-drilled ports 160, which may be associated with cross-drilled port outlets 162. In general, the cross-drilled port outlets 162 may be plugged during operation of the seal assembly 50. As such, the buffer gas entering the buffer port 88 may also enter the buffer cross-drilled ports 160, as illustrated by arrows 164. The flow of the buffer gas into the buffer cross-drilled ports 160 as well as the buffer port 88 enables the buffer gas to spread across the pinion shaft 56 more evenly.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a compression stage rotor assembly, comprising:

a compressor impeller configured to compress a corrosive gas within a compressor housing upon rotation about a longitudinal axis;

a pinion shaft coupled to the compressor impeller and configured to rotate the compressor impeller about the longitudinal axis;

a bearing assembly, comprising at least one bearing configured to support the pinion shaft; and a seal assembly, comprising a seal body configured to reduce leakage of the corrosive gas into the bearing assembly, wherein the seal body comprises:

an inlet buffer port configured to receive a compressed buffer gas; and an outlet eduction port configured to expel the corrosive gas and the compressed buffer gas, wherein the inlet buffer port and the outlet eduction port are disposed at a common axial position relative to the longitudinal axis of the compression stage rotor assembly.

2. The system of claim 1, wherein a buffer gas flow of the compressed buffer gas from the inlet buffer port to the outlet eduction port substantially blocks a corrosive gas flow of the corrosive gas from the outlet eduction port to the inlet buffer port.

3. The system of claim 1, wherein a first pressure of the compressed buffer gas is greater than a second pressure of the corrosive gas.

4. The system of claim 1, wherein the inlet buffer port is fluidly coupled to an oil seal portion of the seal assembly.

5. The system of claim 1, comprising a seal insert configured to fit within the seal body.

6. The system of claim 5, wherein the seal insert comprises a first annular recess and the seal body comprises a second annular recess, and wherein the first and second annular recesses form an eduction collection region configured to collect the corrosive gas and to direct the corrosive gas into the outlet eduction port.

7. The system of claim 5, wherein the seal insert comprises a babbitted surface and the pinion shaft comprises teeth configured to mate with the babbitted surface of the seal insert at a seal interface, wherein the seal interface is configured to reduce leakage of the corrosive gas into the outlet eduction port.

8. The system of claim 1, wherein the seal body comprises teeth configured to mate with the pinion shaft at a seal interface, wherein the seal interface is configured to reduce a corrosive gas flow of the corrosive gas into the inlet buffer port and configured to reduce a buffer gas flow of the compressed buffer gas into the outlet eduction port and a gearbox cavity.

9. The system of claim 1, wherein the outlet eduction port is fluidly coupled to an inlet to the compressor impeller.

10. The system of claim 1, wherein the inlet buffer port is fluidly coupled to a gas seal portion of the seal assembly.

11. The system of claim 1, wherein the inlet buffer port is fluidly coupled to a plurality of cross ports disposed circumferentially about the longitudinal axis of the compression stage rotor assembly.

12. The system of claim 1, wherein the inlet buffer port is fluidly coupled to a gas seal portion and an oil seal portion of the seal assembly.

13. A system, comprising:

an annular seal configured to block leakage of a first gas from a first axial location of a shaft to a second axial location of the shaft, wherein the annular seal comprises an inlet port configured to receive a second gas and an outlet port configured to expel the first and second gases, wherein the inlet port and the outlet port are disposed at a common axial position relative to a longitudinal axis of the annular seal.

14. The system of claim 13, wherein the inlet port is fluidly coupled to a gas seal portion and an oil seal portion of the annular seal.

15. The system of claim 13, wherein the inlet port is fluidly coupled to a gas seal portion of the annular seal.

16. The system of claim 13, wherein the inlet port is fluidly coupled to an oil seal portion of the annular seal.

17. The system of claim 13, comprising a compressor having at least one compression stage with the annular seal, wherein the outlet port is fluidly coupled to an inlet of the first gas into the compressor.

18. The system of claim 13, wherein the inlet port is fluidly coupled to a plurality of cross ports disposed circumferentially about the longitudinal axis of the annular seal.

19. A method, comprising:

injecting a buffer gas flow of a buffer gas into a body of a seal via an inlet port;

blocking a working gas flow of a working gas from a working gas inlet by opposing the working gas flow with the buffer gas flow; and expelling the buffer and working gas flows from the body of the seal via an outlet port, wherein the inlet port and the outlet port are disposed at a common axial position relative to a longitudinal axis of the seal.

20. The method of claim 19, comprising compressing the buffer gas to a first pressure greater than a second pressure of the working gas.

21. The method of claim 19, comprising blocking the working gas flow of the working gas from axially traversing a shaft surrounded by the body of the seal.

22. The method of claim 19, comprising blocking the working gas flow of the working gas from entering a gearbox cavity of a compressor adjacent the body of the seal.

23. The method of claim 19, comprising directing the expelled buffer and working gas flows into the working gas inlet into a gas compressor.

24. The method of claim 19, wherein the inlet port is fluidly coupled to an oil seal portion of the seal.

25. The method of claim 19, wherein the inlet port is fluidly coupled to a plurality of cross ports disposed circumferentially about the longitudinal axis of the seal.

26. The method of claim 19, wherein the outlet port is fluidly coupled to the working gas inlet.

27. The method of claim 19, wherein the inlet port is fluidly coupled to a gas seal portion and an oil seal portion of the seal.

* * * * *